US007680438B2

(12) United States Patent
Yano

(10) Patent No.: US 7,680,438 B2
(45) Date of Patent: Mar. 16, 2010

(54) IMAGE FORMING APPARATUS HAVING CONTACTLESS TYPE TEMPERATURE SENSOR

(75) Inventor: Takashi Yano, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/241,242

(22) Filed: Sep. 30, 2008

(65) Prior Publication Data

US 2009/0028595 A1 Jan. 29, 2009

Related U.S. Application Data

(63) Continuation of application No. 11/627,595, filed on Jan. 26, 2007, now Pat. No. 7,522,861.

(30) Foreign Application Priority Data

Jan. 30, 2006 (JP) ..... 2006-020845

(51) Int. Cl.
*G03G 15/16* (2006.01)

(52) U.S. Cl. ..... 399/122; 399/69; 399/102

(58) Field of Classification Search ..... 399/122, 399/69, 102

See application file for complete search history.

(56) References Cited

U.S. PATENT DOCUMENTS

| | | | | |
|---|---|---|---|---|
| 7,522,861 | B2 * | 4/2009 | Yano | 399/122 |
| 2003/0227533 | A1 | 12/2003 | Yokoi | |
| 2005/0220505 | A1 | 10/2005 | Hashimoto et al. | |

FOREIGN PATENT DOCUMENTS

| | | |
|---|---|---|
| JP | 2001-228742 | 8/2001 |
| JP | 2002-296953 | 10/2002 |
| JP | 2003-98866 | 4/2003 |

* cited by examiner

*Primary Examiner*—David P Porta
*Assistant Examiner*—Bryan P Ready
(74) *Attorney, Agent, or Firm*—Fitzpatrick, Cella, Harper & Scinto

(57) ABSTRACT

A sealing member which is compressed by a contactless temperature sensor and a cover member of a fixing unit is provided between the sensor and the cover member. An opening portion for temperature detection is shut off from a space around the fixing unit by the sealing member, thereby preventing the air from flowing from the opening portion into the fixing unit.

9 Claims, 6 Drawing Sheets

IMAGE FORMING APPARATUS HAVING CONTACTLESS TYPE TEMPERATURE SENSOR

This is a continuation of co-pending U.S. patent application Ser. No. 11/627,595, filed Jan. 26, 2007.

BACKGROUND OF THE INVENTION

1. Field of the Invention

The present invention relates to an image forming apparatus such as copying apparatus and printer having a function of forming an image onto a recording medium such as a sheet and, more particularly, to an image forming apparatus having a contactless type temperature sensor.

2. Description of the Related Art

Hitherto, in an image forming apparatus, a toner image formed on a sheet is thermally fixed onto a sheet surface by using a fixing unit (fixing roller, fixing belt) having a heat source. Since a management of a fixing temperature in this instance is very important to stabilize sheet conveying performance and image quality, generally, proper heating control is made to the heat source while monitoring a temperature of a surface of the fixing unit by using a temperature detecting sensor.

Hitherto, a contact type sensor such as a thermistor has widely been used as a temperature detecting sensor.

However, if the contact type sensor is used, since surface states (temperature distribution and a consumption degree) of the fixing roller and the fixing belt, particularly, only regions which come into contact with the sensor change, such a change is liable to appear as a gloss variation on the image fixed onto the sheet. Since micro toner foulings deposited onto the fixing roller and the fixing belt are accumulated into the contact type sensor, there is such a problem that when the accumulated fouling is suddenly peeled off, it is deposited onto the fixed image.

Since it is necessary to avoid those problems in order to realize high picture quality of the image forming apparatus, a contactless type sensor such as a thermopile is becoming a main stream.

However, since the contactless type sensor is very expensive, if it is built in the fixing unit which is presumed to be exchanged as consumables, it directly exerts an influence on the costs of the consumables. Since such a sensor is a contactless type, it has to be arranged at a predetermined distance from the surface of one of the fixing roller and the fixing belt. Therefore, when the sensor is built in the fixing unit, it is necessary to assure a certain space into the fixing unit.

From the above circumstances, as a construction of the image forming apparatus, generally, the contactless type sensor is provided on the image forming apparatus main body side and the temperature of the fixing unit is detected through an opening portion for temperature detection provided for a cover of the fixing unit.

As literatures disclosing the related arts, there are Japanese Patent Application Laid-Open Nos. 2001-228742, 2002-296953, and 2003-098866.

FIG. 5 illustrates a conventional construction in which a contactless type sensor 151 is provided on the main body side of an image forming apparatus 150 and a temperature of a fixing unit 140 is detected through an opening portion for temperature detection 144 provided for a cover 143 of a fixing unit 125.

In such a conventional construction, there is a case where the temperature detection is influenced by a flow (shown by an arrow in FIG. 5) of the air around the fixing unit.

Such a problem occurs because the low-temperature air out of the fixing unit flows from the temperature detecting opening portion 144 provided for the cover 143 of the fixing unit and the surface temperature of the fixing unit 140 is locally cooled. A controller of the image forming apparatus makes the heating control to the heat sources 142 of the fixing unit so as to maintain a temperature of a cooled detection area 140*a* to a target control temperature. Therefore, temperatures of areas other than the detection area exceed the target temperature. The over-temperature of the fixing unit becomes a cause of winding of a sheet or an over-gloss of the picture quality. A temperature difference between the detection area and the other areas becomes a cause of the gloss variation of the fixed image.

Generally, there is a tendency that a flow occurs in the air around the fixing unit by a heat convection. Especially, in the construction in which the contactless type sensor is arranged under the fixing unit, an influence of the heat convection from the temperature detecting opening portion is liable to occur. In dependence on the apparatus construction, a heat insulating air flow is often formed near the fixing unit in order to protect an image forming portion adjacent to the fixing unit and a laser scanner from the heat. In such a case, the air flows easily from the temperature detecting opening portion into the fixing unit in terms of such characteristics of the air that flows in the direction of a lower atmospheric pressure. The problem of deterioration in temperature detecting precision appears further typically.

As a conventional method of avoiding the foregoing problems, as illustrated in FIG. 6, a method whereby a window 145 made of an infrared transmitting material is attached to the temperature detecting opening portion 144 of the fixing unit 125 and the inflow of the air is prevented has been known.

However, since transmittance of infrared rays of the window 145 made of the infrared transmitting material changes depending on the surface state, there is a risk that the detecting precision becomes unstable due to a factor such as variation among parts or deposition of the fouling. When the sheet passes through the fixing unit 125, there is a case where the inner surface of the window 145 forms dew and becomes cloudy by an influence of the moisture evaporated from the sheet by the heat. Thus, there is also a risk that the temperature cannot be detected but an abnormality occurs in the heating control and, in the worst case, a temperature of the fixing unit exceeds a limit temperature and the fixing unit is broken.

SUMMARY OF THE INVENTION

The invention is made in consideration of the foregoing problems and it is an object of the invention to provide an image forming apparatus which can improve temperature detecting precision of a temperature detecting sensor.

Another object of the invention is to provide an image forming apparatus in which the air is difficult to flow from a portion around a fixing unit into a temperature detecting opening portion provided for an outer casing of the fixing unit.

Still another object of the invention is to provide an image forming apparatus comprising: an apparatus main body; an image fixing unit which is detachably provided for the apparatus main body and has a heating member which heats an image on a recording material; a temperature sensor which is attached to the apparatus main body and detects the temperature of the heating member through an opening formed in an outer casing of the fixing unit; and an elastic seal which surrounds a space between the opening of the fixing unit and the temperature sensor.

Further another object of the invention is to provide an image forming apparatus comprising: an apparatus main body; an image fixing unit which is detachably provided for the apparatus main body and has a heating member which heats an image on a recording material; a temperature sensor which is attached to the apparatus main body, and detects the temperature of the heating member through an opening formed in an outer casing of the fixing unit, wherein a virtual line connecting the temperature sensor and a center of the opening of the fixing unit in the state where the fixing unit has been attached to the apparatus main body crosses the direction in which the fixing unit is attached to the apparatus main body; a sealing member which surrounds a space between the opening of the fixing unit and the temperature sensor; and an urging member which urges the sealing member toward the fixing unit side.

Further features of the present invention will become apparent from the following description of exemplary embodiments with reference to the attached drawings.

DESCRIPTION OF THE EMBODIMENTS

Exemplary embodiments for embodying the invention will be described in detail hereinbelow by examples with reference to the drawings. Dimensions, materials, and shapes of component parts disclosed in the embodiments, their relative layout should be properly changed according to a construction of an apparatus to which the invention is applied and various conditions. It does not mean that a scope of the invention is not limited to the following embodiments.

First Embodiment

Figure 1:
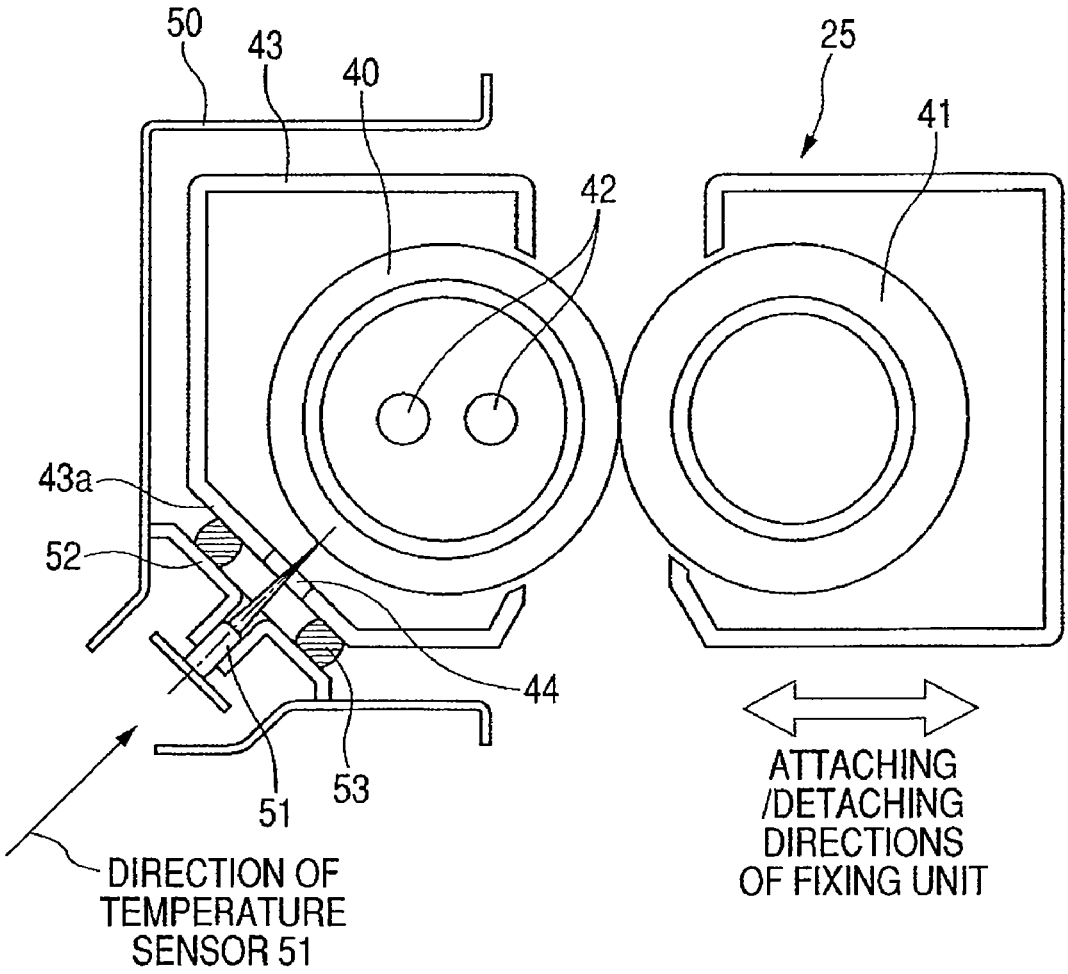
FIG. 1 is a schematic cross sectional view of a fixing unit and its peripheral component elements in an image forming apparatus of a first embodiment of the invention.
Figure 4:
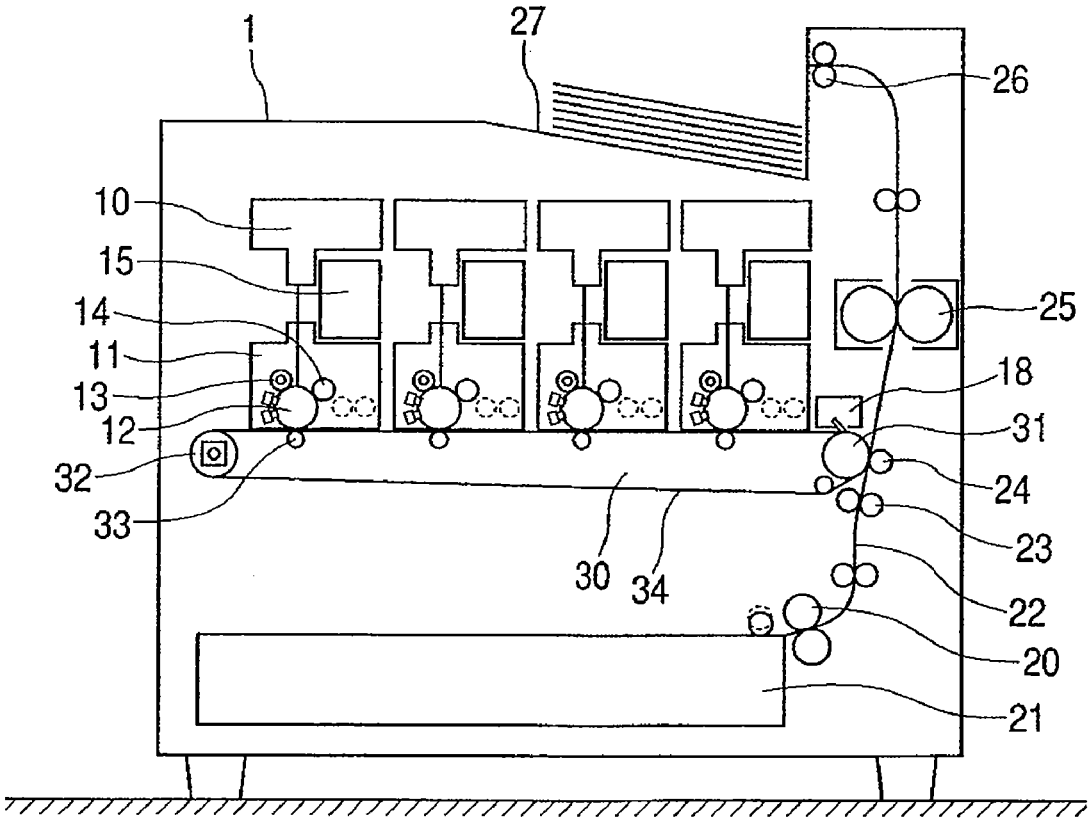
FIG. 4 is a schematic cross sectional view of the image forming apparatus to which the invention is applied.
Figure 5:
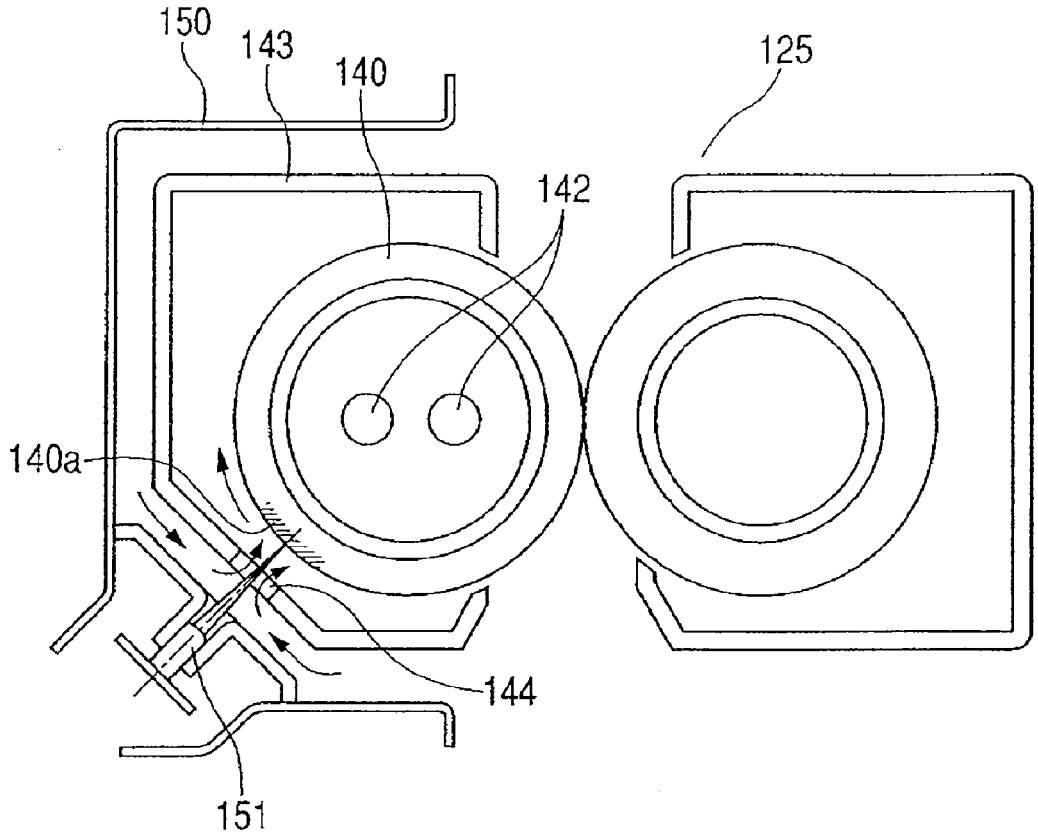
FIG. 5 PRIOR ART
FIG. 5 is a schematic cross sectional view of a fixing unit and its peripheral component elements for explaining a conventional general contactless temperature detecting construction.
Figure 6:
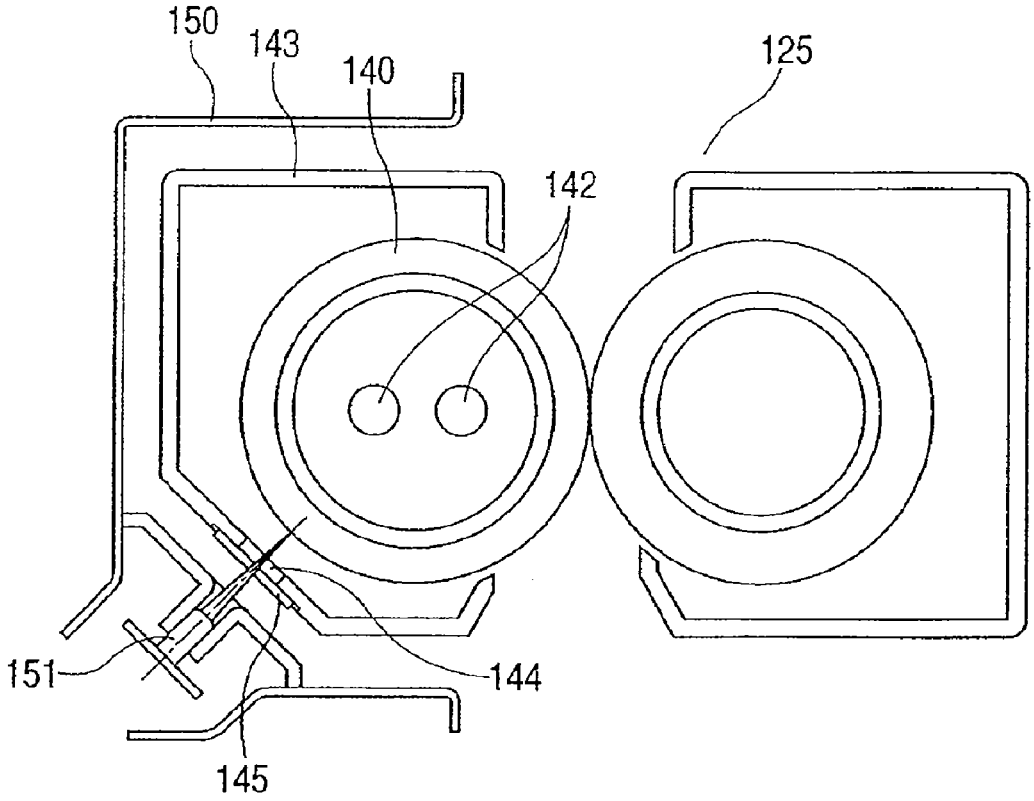
FIG. 6 PRIOR ART
FIG. 6 is a schematic cross sectional view of the fixing unit and its peripheral component elements for explaining an example of a conventional countermeasure.

A first embodiment of the invention will be described with reference to FIGS. 1 and 4. FIG. 1 is a schematic cross sectional view of a fixing unit and its peripheral component elements in an image forming apparatus of the first embodiment of the invention. FIG. 4 is a schematic cross sectional view of the image forming apparatus (hereinafter, referred to as a printer) to which the invention is applied.

FIG. 4 illustrates a printer main body 1. An engine portion to form primary images of four colors in total of yellow, magenta, cyan, and black is arranged in an upper portion of the printer main body 1.

Print data transmitted from an external apparatus such as a personal computer is received by a controller for controlling the printer main body 1 and output as writing image data to a laser scanner 10 of each color. The laser scanner emits a laser beam onto a photosensitive drum 12 and draws a light image according to the writing image data.

The engine portion has a toner cartridge 15 for supplying toner each color and a processing cartridge 11 for forming the primary image for each color. The processing cartridge 11 has the photosensitive drum 12, a charging device 13, a developing device 14, and a cleaner (not shown). The charging device 13 is used to uniformly charge the surface of the photosensitive drum 12.

The laser scanner 10 draws the light image onto the surface of the photosensitive drum 12 charged by the charging device 13, so that an electrostatic latent image is formed. The developing device 14 develops the electrostatic latent image into a toner image to be transferred onto an intermediate transfer belt 34. The cleaner removes the toner remaining on the photosensitive drum 12 after the toner image was transferred.

A primary transfer roller 33 is arranged at a position where the photosensitive drum 12 faces the roller 33 in order to transfer the toner image developed on the surface of the photosensitive drum 12 to the intermediate transfer belt 34.

The toner image (primary image) transferred to the intermediate transfer belt 34 is transferred again onto the sheet by a secondary transfer roller 24. The residual toner which was not transferred by the secondary transfer roller 24 is collected by a cleaner 18.

The engine portion to form the primary image, the intermediate transfer belt 34, the primary transfer roller 33 to transfer the image to the intermediate transfer belt 34, and the secondary transfer roller 24 mentioned above construct an image forming unit.

A feeding unit 20 is located in an uppermost stream of a sheet conveying path and arranged in a lower portion of the printer main body 1. The sheets (recording materials) stacked and enclosed on a feeding tray 21 are fed by the feeding unit 20. The sheet passes through a vertical conveying path 22 and is conveyed toward a downstream side. The vertical conveying path 22 has a registration roller pair 23. Final correction of an oblique motion of the sheet and matching of the image writing timing in the image forming unit and the sheet conveying timing are performed here.

A fixing unit 25 to fix the non-fixed toner image formed on the sheet as a permanent image is arranged on the downstream side of the image forming unit. An ejecting roller 26 to eject the sheet from the printer main body (image forming apparatus main body) 1 is arranged on the downstream side of the fixing unit 25. An ejecting tray 27 to receive the sheet ejected by the ejecting roller 26 is provided outside of the printer main body 1.

The fixing unit 25 according to the embodiment and its peripheral construction will now be described with reference to FIG. 1.

A fixing roller pair arranged in one fixing unit 25 includes a fixing roller 40 locating on the image surface side of the sheet and a pressing roller 41 locating on the non-image surface side. The pressing roller 41 is in pressure contact with the fixing roller 40. The fixing roller 40 has a hollow center portion. Heaters 42 are arranged in the fixing roller 40. The fixing roller 40 and the heaters 42 construct a heating member according to the invention.

At a position near the fixing roller 40, a cover member 43 is arranged over the whole area in the width direction (direction which perpendicularly crosses the sheet conveying direction) of the fixing roller 40. The cover member 43 forms an outer casing of the fixing unit 25 main body. The fixing unit 25 is detachable for the printer main body 1.

The cover member 43 has an opening portion (inspection hole for temperature detection) 44 at a position near the center in the width direction of the fixing roller 40. A contactless temperature sensor 51 as a contactless temperature detecting unit is attached to a position where the sensor 51 faces the surface of the fixing roller 40 through the opening portion 44. The contactless temperature sensor 51 is fixed to a frame 50 of the printer main body 1 through a sensor holder 52.

A sealing member (elastic seal) 53 as a sealing unit as a feature of the embodiment will be described hereinbelow.

A heat insulating sealing member 53 which is compressed by the sensor holder 52 and the cover member 43 is adhered to the surface of the sensor holder 52 which faces the fixing unit 25. That is, the sealing member 53 is attached to the printer main body 1. In the embodiment, a silicon sponge (foaming material) is used as a sealing member 53. In the embodiment, since the sealing member 53 is attached to the printer main body 1, the costs of the fixing unit as consumables can be suppressed.

The sealing member 53 is arranged so as to surround a periphery of a detecting element of the contactless temperature sensor 51. In the state where the fixing unit 25 is attached to the printer main body 1, the sealing member 53 is located at a position where it surrounds a periphery of the opening portion 44 of the cover member 43. The sealing member in the embodiment has a ring shape. The temperature sensor 51 detects the temperature of the fixing roller 40 through a hole portion of the sealing member. When the sealing member 53 is sandwiched between the sensor holder 52 and the cover member 43 and compressed, the opening portion 44 of the cover member 43 is shut off from an ambient space of the fixing unit 25. In this manner, the sealing member (elastic seal) 53 has a role of surrounding the space between an opening portion 44 of the fixing unit 25 and the temperature sensor 51.

When the inflow of the atmosphere around the fixing unit 25 to the fixing roller 40 side from the opening portion 44 of the cover member 43 is prevented owing to the space shut-off effect of the sealing member 53, the temperature of the surface layer area of the fixing roller 40 which is monitored by the contactless temperature sensor 51 is not influenced by the open air. Therefore, the temperature control of the fixing unit 25 can be stabilized.

By applying the embodiment to the problem which has conventionally occurred in the case of using the contactless type sensor, that is, to the phenomenon in which the air flows from the temperature detecting opening portion of the fixing unit and the surface temperature of the fixing unit decreases locally, the air inflow can be shut off and the decrease in temperature can be prevented. Thus, the temperature of the fixing roller 40 can be accurately detected. Further, the temperature variation of the surface of the fixing roller 40 is eliminated and the image quality can be improved.

According to the embodiment, the conventional countermeasure against the air inflow, that is, the problem in the method of detecting the temperature through the window of the infrared transmitting material can be also solved. That is, the problem of a detection error in which the infrared transmittance varies depending on the surface state of the infrared transmitting material can be solved. The risk that the inside of the infrared transmitting material becomes cloudy by the moisture dispersed from the sheet upon fixing and the temperature cannot be detected can be also solved.

As will be understood by referring to FIG. 1, a virtual line (that is, the direction of the temperature sensor 51) connecting the temperature sensor 51 and the center of the opening portion 44 of the fixing unit in the state where the fixing unit 25 has been attached to the apparatus main body 1 crosses the direction in which the fixing unit 25 is attached to the apparatus main body 1. As mentioned above, the direction of the temperature sensor and the attaching/detaching directions of the fixing unit cannot be made parallel because of a design convenience, a gap is liable to occur between the temperature sensor 51 and the fixing unit 25 in the case of a non-elastic seal and hermetical performance deteriorates. However, if the elastic seal is used like an embodiment, the elastic seal is deformed according to the attaching operation of the fixing unit (according to the movement of a surface 43*a* of the cover member 43), so that the hermetical performance between the temperature sensor 51 and the fixing unit 25 can be improved.

Owing to the above effects, the high precision, reliability, and stability can be improved with respect to the temperature detection and temperature control of the fixing unit by the contactless type sensor.

Although the cover member 43 has been arranged over the whole area in the width direction of the fixing roller 40 in the embodiment, the invention is not limited to such a structure but it is sufficient that at least a part of the fixing unit 25 is covered with the cover member 43. The cover member 43 may be a member constructing a frame (frame body) of the fixing unit 25.

Although the silicon sponge is used as a sealing member 53 in the embodiment, the sealing member 53 is not limited to the silicon sponge but may be made of a rubber-like elastic material.

The attaching position of the contactless temperature sensor 51 is not limited so long as the sealing member 53 for sealing the air which flows from the opening portion 44 toward the fixing roller 40 is arranged around the opening portion 44 of the cover member 43 and arranged between the cover member 43 and the contactless temperature sensor 51.

Although the sealing member 53 has been provided on the contactless temperature sensor 51 side in the embodiment, the invention is not limited to such a structure. Even if the sealing member is provided on the fixing unit 25 side, an effect similar to that mentioned above can be obtained. In this case, since the sealing member 53 can be exchanged together with the fixing unit 25, even if the sealing performance of the sealing member 53 has deteriorated by an influence of the heat or the like of the fixing unit, the sealing function can be refreshed simultaneously with the exchange of the fixing unit 25.

Second Embodiment

Figure 2A:
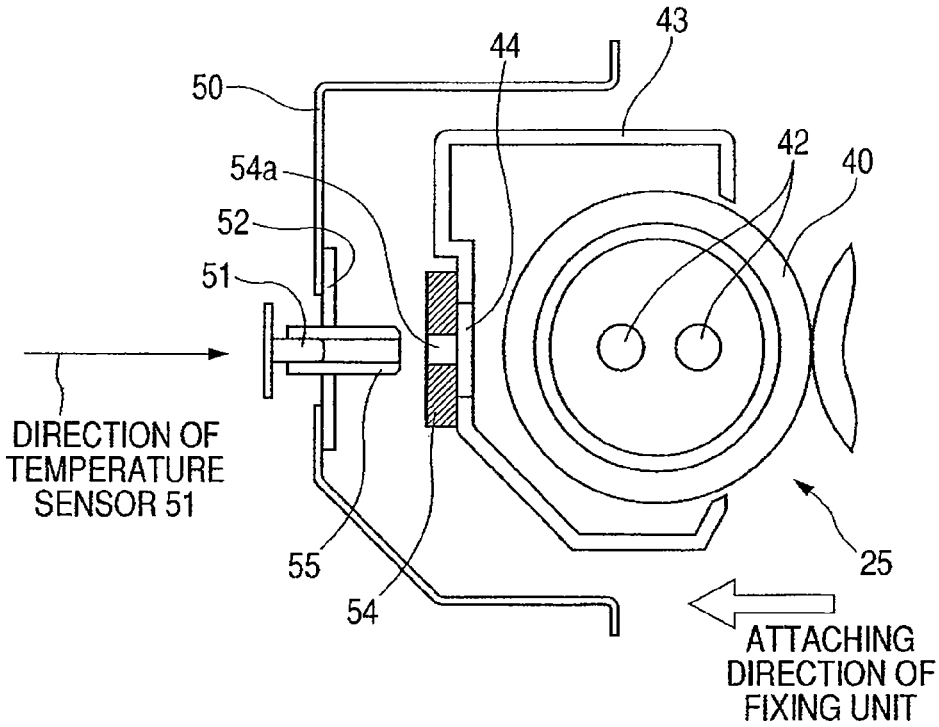
FIGS. 2A and 2B are schematic cross sectional views of a fixing unit and its peripheral component elements in an image forming apparatus of a second embodiment of the invention.
Figure 2B:
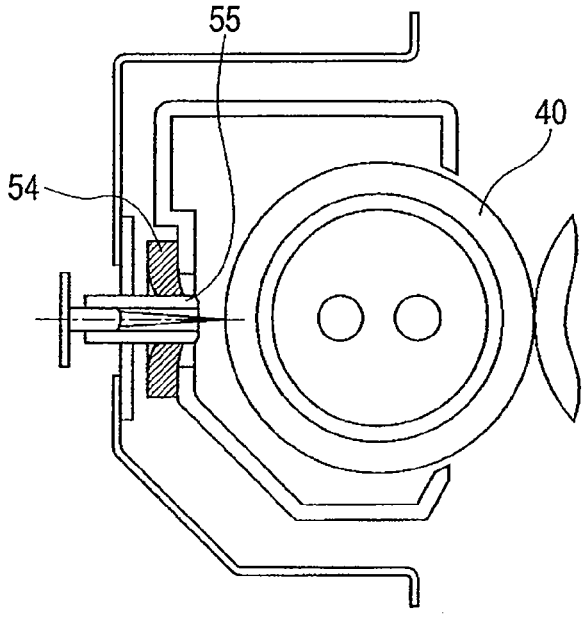

FIGS. 2A and 2B are diagrams illustrating the second embodiment. FIG. 2A illustrates a state before the fixing unit 25 is attached to the printer main body 1. FIG. 2B illustrates a state where the fixing unit 25 has been attached. In FIGS. 2A and 2B, component elements similar to those in FIG. 1 are designated by the same reference numerals and their description is omitted.

In the embodiment illustrated in FIGS. 2A and 2B, a sealing member 54 as a sealing unit is provided on the cover member 43 of the fixing unit 25. The virtual line (that is, the direction of the temperature sensor 51) connecting the temperature sensor 51 and the center of the opening portion 44 of the fixing unit in the state where the fixing unit 25 has been attached to the apparatus main body 1 is almost parallel with the direction in which the fixing unit 25 is attached to the apparatus main body 1.

In the sealing member 54, a hole portion 54*a* smaller than the opening portion 44 is formed near the center of the opening portion 44 of the cover member 43. A convex-shaped cylinder portion 55 which surrounds a detection directional axis (center axis extending in the detecting direction) of the contactless temperature sensor 51 is formed in the sensor holder 52 which holds the contactless temperature sensor 51. An outer diameter of the cylinder portion 55 is larger than an inner diameter of the hole portion 54*a* of the sealing member 54.

When the fixing unit 25 is attached to the printer main body 1, the cylinder portion 55 of the sensor holder 52 is inserted into the hole portion 54*a* of the sealing member. At this time, since the outer diameter of the cylinder portion 55 is larger than the inner diameter of the hole portion 54*a*, the hole portion 54*a* is widened while being compressed. Since the cylinder portion 55 penetrates the hole portion 54*a*, the sealing member 54 is adhered to the cylinder portion 55.

Even if there is a small variation in the position of the fixing unit 25 to the contactless temperature sensor 51, so long as a variation amount lies within a traceable range due to the compression deformation of the sealing member 54, the cylinder portion 55 is adhered to the hole portion 54*a*. Owing to the relation between them, the space in the opening portion 44 of the cover member 43 and the space around the fixing unit 25 are shut off, thereby preventing the air around the fixing unit from flowing into the fixing unit.

Third Embodiment

Although the example in which the raw material itself of the sealing member can be compressed and deformed (elastic deformation) has been described in the first and second embodiments, an effect similar to that in the first embodiment can be also obtained by another construction. A third embodiment of the invention will now be described with reference to FIGS. 3A and 3B.

Figure 3A:
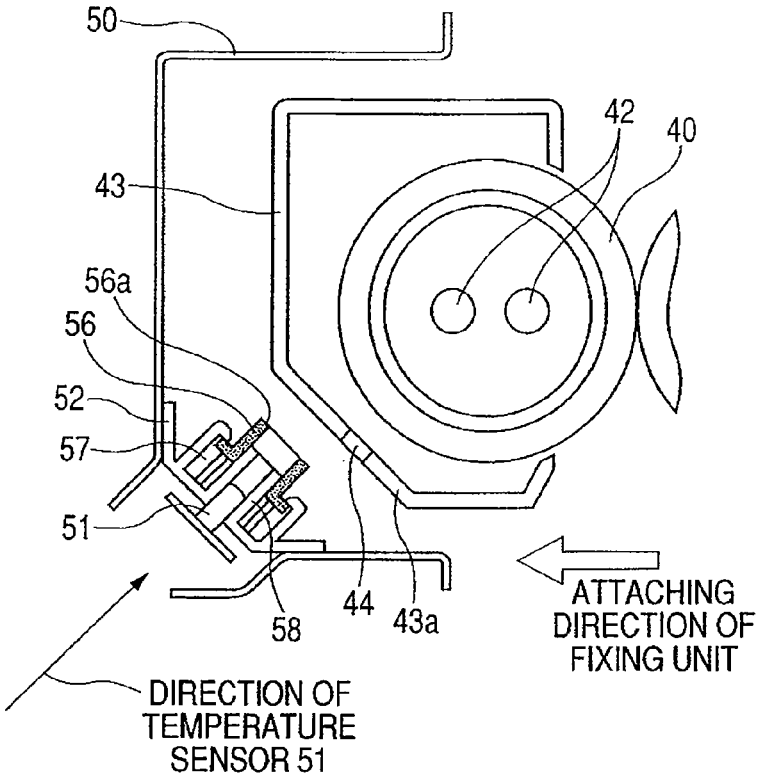
FIGS. 3A and 3B are schematic cross sectional views of a fixing unit and its peripheral component elements in an image forming apparatus of a third embodiment of the invention.
Figure 3B:
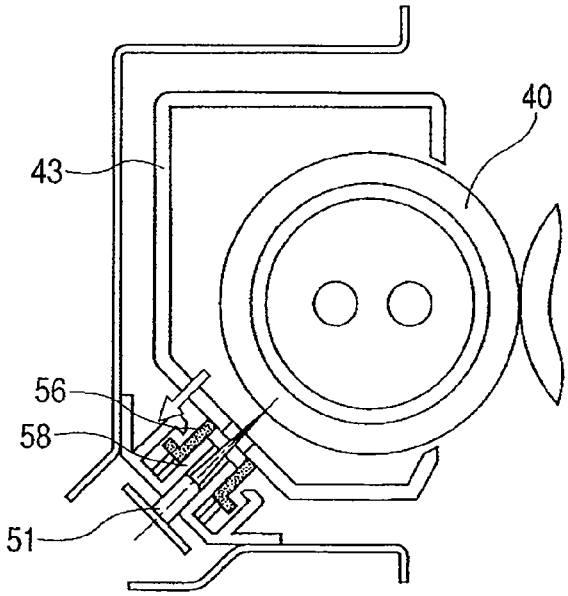

FIGS. 3A and 3B are schematic cross sectional views of the fixing unit 25 and its peripheral component elements according to the third embodiment of the invention. FIG. 3A illustrates a state before the fixing unit 25 is attached to the printer main body 1. FIG. 3B illustrates a state where the fixing unit 25 has been attached. A construction of the fixing unit 25 and a construction in which the contactless temperature sensor 51 has been fixed to the frame 50 of the printer main body 1 through the sensor holder 52 are similar to those in the first embodiment. Component elements similar to those in the first embodiment are designated by the same reference numerals and their description is omitted.

A guide portion 58 is formed in the sensor holder 52 so as to surround the detecting element of the contactless temperature sensor 51. A movable shielding member (movable member) 56 as a sealing unit has been fitted into the guide portion 58. The movable shielding member 56 is urged to a detection portion (that is, a portion to be detected) (fixing roller 40 in the state where the fixing unit has been attached as illustrated in FIG. 3B) side by an urging spring (urging member) 57. The movable shielding member 56 is supported by the guide portion 58 so as to be slidable in the detecting direction (direction in which the contactless temperature sensor 51 detects the detection portion). The movable shielding member 56 is made of a heat insulating resin material. The compression deformation occurring in the first embodiment does not occur in the movable shielding member 56. The virtual line (that is, the direction of the temperature sensor 51) connecting the temperature sensor 51 and the center of the opening portion 44 of the fixing unit in the state where the fixing unit 25 has been attached to the apparatus main body 1 crosses the direction in which the fixing unit 25 is attached to the apparatus main body 1.

In the cover 43 of the fixing unit in the embodiment, the surface 43*a* which comes into contact with the movable shielding member 56 is a flat surface which hardly has a stairway portion. Even if such a surface 43*a* comes into contact with an edge surface 56*a* of the movable shielding member 56, high slidability is obtained.

When the fixing unit 25 is attached to the printer main body 1, since the edge surface of the movable shielding member 56 comes into contact with the cover member 43 of the fixing unit 25 and receives a force, the movable shielding member 56 refuges to the contactless temperature sensor 51 side.

In this instance, the opening portion 44 of the cover member 43 is shut off from the space around the fixing unit 25 owing to the pressure contact relation between the edge surface of the movable shielding member 56 and the cover member 43 and owing to the fitting relation between the movable shielding member 56 and the guide portion 58 of the sensor holder 52. Therefore, the air around the fixing unit 25 is prevented from flowing into the fixing unit 25.

When the direction of the temperature sensor and the attaching/detaching directions of the fixing unit cannot be made parallel with each other in terms of a design convenience as mentioned above, in the case of the non-elastic shielding member 56, the gap is liable to occur between the temperature sensor 51 and the fixing unit 25 and the hermetical performance deteriorates. However, by using the construction in which the shielding member 56 can refuge and forming the surface 43*a* as a flat surface which hardly has a stairway portion as mentioned in the embodiment, the surfaces 43*a* and 56*a* slide according to the attaching operation of the fixing unit (according to the movement of the surface 43*a* of the cover member 43), so that the hermetical performance between the temperature sensor 51 and the fixing unit 25 can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-020845, filed Jan. 30, 2006, which is hereby incorporated by reference herein in its entirety.

What is claimed is:

1. An image forming apparatus comprising:

an apparatus main body;

an image fixing unit which is detachably provided for the apparatus main body and has a heating member which heats an image on a recording material;

a temperature sensor which is attached to the apparatus main body and detects the temperature of the heating member through an opening formed in an outer casing of the fixing unit; and an elastic seal which has a ring shape, which is arranged so that a position of a hole of the ring aligns with a position of the opening of the fixing unit in a state where the fixing unit has been attached to the apparatus main body, and which surrounds a space between the opening of the fixing unit and the temperature sensor in the state where the fixing unit has been attached to the apparatus main body.

2. An apparatus according to claim 1, wherein the elastic seal has been compressed by the apparatus main body and the fixing unit in the state where the fixing unit has been attached to the apparatus main body.

3. An apparatus according to claim 2, wherein a virtual line connecting the temperature sensor and a center of the opening of the fixing unit in the state where the fixing unit has been attached to the apparatus main body crosses the direction in which the fixing unit is attached to the apparatus main body.

4. An apparatus according to claim 1, wherein the elastic seal is attached to the fixing unit.

5. An apparatus according to claim 1, wherein the elastic seal is attached to the apparatus main body.

6. An apparatus according to claim 1, wherein a virtual line connecting the temperature sensor and a center of the opening of the fixing unit in the state where the fixing unit has been attached to the apparatus main body is almost parallel with the direction in which the fixing unit is attached to the apparatus main body.

7. An apparatus according to claim 6, wherein when the fixing unit is attached to the apparatus main body, the temperature sensor or a holder which holds the temperature sensor is inserted into a hole portion of the elastic seal.

8. An image forming apparatus comprising:

an apparatus main body;

an image fixing unit which is detachably provided for the apparatus main body and has a heating member which heats an image on a recording material;

a temperature sensor which is attached to the apparatus main body and detects the temperature of the heating member through an opening formed in an outer casing of the fixing unit, wherein a virtual line connecting the temperature sensor and a center of the opening of the fixing unit in the state where the fixing unit has been attached to the apparatus main body crosses the direction in which the fixing unit is attached to the apparatus main body;

a sealing member which has a ring shape, which is arranged so that a position of a hole of the ring aligns with a position of the opening of the fixing unit in a state where the fixing unit has been attached to the apparatus main body, and which surrounds a space between the opening of the fixing unit and the temperature sensor in the state where the fixing unit has been attached to the apparatus main body; and an urging member which urges the sealing member toward the fixing unit side.

9. An apparatus according to claim 8, wherein in a cover of the fixing unit, a surface which faces the sealing member is a flat surface which hardly has a stairway portion.

* * * * *